US008186018B2

(12) United States Patent
Martin

(10) Patent No.: US 8,186,018 B2
(45) Date of Patent: May 29, 2012

(54) AUXILIARY HANDLE FOR HAND-HELD POWER TOOL

(75) Inventor: Paul Martin, Karlsrube (DE)

(73) Assignee: Hilti Aktiengesellschaft, Schaan (LI)

( * ) Notice: Subject to any disclaimer, the term of this patent is extended or adjusted under 35 U.S.C. 154(b) by 246 days.

(21) Appl. No.: 12/584,912

(22) Filed: Sep. 14, 2009

(65) Prior Publication Data

US 2010/0064482 A1 Mar. 18, 2010

(30) Foreign Application Priority Data

Sep. 15, 2008 (DE) ..... 10 2008 042 113

(51) Int. Cl.
*B25G 1/10* (2006.01)
*A45C 13/26* (2006.01)

(52) U.S. Cl. ..... 16/426; 16/422; 16/436

(58) Field of Classification Search ..... 16/426, 16/408, 429, 436; 294/58; 408/124, 241 R; 173/161, 162.1, 162.2; 81/177.6, 177.7, 81/177.8, 177.9
See application file for complete search history.

(56) References Cited

U.S. PATENT DOCUMENTS 6,499,172 B1 * 12/2002 McCracken ..... 15/97.1
6,553,627 B1 * 4/2003 Horler ..... 16/426
7,198,188 B2 * 4/2007 Dion et al. ..... 227/110
2004/0163214 A1 8/2004 Cheng
2007/0209162 A1 * 9/2007 McRoberts et al. ..... 16/426
2009/0000434 A1 1/2009 Shinma
2009/0178520 A1 7/2009 Engelfried

FOREIGN PATENT DOCUMENTS

DE 44 22 247 A1 1/1996
EP 1400317 A1 * 3/2004
GB 2124536 A * 2/1984
GB 2444169 A * 5/2008
JP 2000176864 A * 6/2000
JP 2006321008 A * 11/2006

* cited by examiner

*Primary Examiner* — Chuck Y. Mah

(74) *Attorney, Agent, or Firm* — Abelman, Frayne & Schwab

(57) ABSTRACT

An auxiliary handle for a hand-held power tool (7) includes a lockable lag hinge (46) provided between the clamping section (21) and the gripping member (34) and having a pivot pin (47), a tightening member (51) for tightening and loosening the clamping section (21) and arranged on an end (48) of the pivot pin (47) of the lag hinge (46), a locking device (41) for locking and releasing the lag hinge (46), and an independent from the tensioning member (51), a quick-release device (56) for the locking device (41) and the clamping section (21) for displacing the locking device (410 in a position in which the lag hinge (46) is released and for loosening tightening of the clamping section (21).

13 Claims, 3 Drawing Sheets

AUXILIARY HANDLE FOR HAND-HELD POWER TOOL

BACKGROUND OF THE INVENTION

1. Field of the Invention

The present invention relates to an auxiliary handle for a hand-held power tool such as a power drill, a hammer drill or a chisel hammer and includes a clamping section for securing the auxiliary handle on a section of the power tool, a gripping member for holding the auxiliary handle, a lockable lag hinge provided between the attachment section and the gripping member and having a pivot pin, a tensioning member for tightening and loosening the clamping section and arranged on an end of the pivot pin of the lag hinge, and a locking device for locking and releasing the lag hinge.

2. Description of the Prior Art

In power tools, auxiliary handles of the type described above are provided, if needed, in form of a side handle mounted, e.g., on a housing section adjacent to a tool holder for guiding the power tool. It is known to form a gripping member of the auxiliary handle pivotable about a pivot axis in order to optimally guide the power tool and to enable different gripping positions of the auxiliary handle on the power tool, which would insure a less tiring operation. A lag hinge provides for a pivotal movement of the gripping member relative to the attachment section of the auxiliary handle. The pivoting of the gripping member permits to adjust the gravity point of the power tool with respect to the tool user. Often, the gripping member is adjusted during the power tool use.

In order to prevent an inadvertent re-adjustment of the gripping member of the auxiliary handle in a locking position of the lag hinge, there are usually provided, e.g., between the clamping section and the gripping member, engageable in each other, toothings. For pivoting the gripping member, this engagement should be broken and then again re-established. This occupies an increased amount of time.

German Publication DE 10 2006 055 524 A1 discloses an auxiliary handle for a hand-held power tool and having its clamping section formed as a clamping sleeve for mounting the auxiliary handle on a section of the power tool. The auxiliary handle also includes a gripping member for grasping and holding the auxiliary handle. Between the clamping section and the gripping member, a lockable lag hinge is arranged. The lag hinge has a pivot pin a longitudinal axis of which forms the pivot axis of the lag hinge. Further, there is provided an actuation knob that forms a locking member and is arranged on an end of the pivot pin, being secured on a section of the pivot pin provided with an outer thread. Between the tensioning member and a section of the gripping member, there is provide a cone-shaped, elastically deformable engagement member frictionally engageable in a conically widening recessed opening formed in a section of the gripping member. Between the gripping member and the clamping section, toothings are provided which form a locking device for locking or releasing the lag hinge.

With such design of the auxiliary handle, the required number of revolutions of the locking member for locking and releasing the lag hinge and for tightening and loosening the clamping section is reduced.

The drawback of the above-described auxiliary handle consists in that for releasing the lag hinge and for loosening the clamping section a large number of turns of the tensioning member is necessary.

Accordingly, an object of the present invention is an auxiliary handle for a hand-held power tool in which the above-discussed drawbacks of a known auxiliary handle are eliminated.

Another object of the present invention is an auxiliary handle for a hand-held power tool and that would enable a simple and rapid re-positioning or removal of the auxiliary handle and pivoting of the gripping member.

SUMMARY OF THE INVENTION

These and other objects of the present invention, which will become apparent hereinafter, are achieved by providing an independent from the tensioning member, quick-release device for locking member and the clamping section for displacing the locking member in a position in which the lag hinge is released, and for loosening tightening of the clamping section.

When the quick-release device is actuated, simultaneously, the lag hinge is released and the tightening of the clamping section is loosened. In the released condition, on one hand, the gripping member can be pivoted relative to the clamping section and, on the other hand, the auxiliary handle can be pivoted about the operational axis of the power tool. Because the quick-release device is independent from the tensioning member, no tiresome rotation, e.g., of the tensioning member formed, e.g., as a knob, is any more necessary. The quick-release device is advantageously so formed that the pivot pin is again easily fixed axially in the quick-release device for tightening the clamping section again and for locking the lag hinge again.

Advantageously, the quick-release device includes a fixation device for axially securing the pivot pin, and an actuation member for operating the fixation device so that the fixation device releases the pivot pin. Upon actuation of the actuation member, which advantageously can be actuated by one finger of one hand, the axial fixation of the pivot pin is lifted off, and the pivot pin becomes axially displaceable. Thereby, simultaneously, the lag hinge is released and tightening of the clamping section, e.g., tightening of the tightening band is loosened.

Advantageously, the actuation member is provided on an end of the pivot pin opposite the end on which the tensioning member is arranged. This provides for an advantageous construction and, thus, for an advantageous manufacturing of the auxiliary handle. This construction also insures an easy actuation of the quick-release device.

Advantageously, the actuation member is formed as a pressure knob axially displaceable along the pivot axis of the lag hinge. This insures an easy actuation and operation of the quick-release device.

Advantageously, the fixation device includes at least one pivot element radially deflectable relative to the pivot axis of the lag hinge and having a stop section engageable with the pivot pin and a control section engageable with the actuation member.

Upon actuation of the actuation member, it acts, via the control section, on the pivot element, causing disengagement of the stop section and the pivot pin. Thereby, the pivot pin becomes axially displaceable, providing for loosening of the auxiliary handle. With the fixation device according to the invention, the pivot pin can be easily axially secured because it can be inserted in the fixation device only with its end remote from the tensioning member.

Advantageously, the at least one pivot element is supported for a pivotal movement on pivot support that advantageously is provided between the control and stop sections. Upon actuation of the actuation member, the stop section of the at least one pivot element advantageously pivots radially outwardly. After the at least one pivot element pivots back to its preceding position, the pivot pin is axially fixed again.

Advantageously, the fixation device has a plurality of radially deflectable pivot elements arranged radially outwardly with respect to the pivot axis. Advantageously, the pivot elements are uniformly circumferentially distributed. This provides a sufficiently large contact surface for axially securing the pivot pin.

Advantageously, there is provided a spring element for biasing the stop section of the at least one pivot element in a direction of the pivot axis. The spring element is formed, e.g., as a ring of a spring material such as rubber, or as a steel spring ring, or as a separate springy element acting radially inwardly or radially outwardly. The spring element acts as a return element for the at least one pivot element. Thereby, the at least one pivot element is forcefully returned in its fixing position for axially securing the pivot pin. In particular, with the fixation device having a plurality of deflectable radially outwardly, pivot elements, the spring element insures a concentric arrangement of the pivot elements.

Advantageously, the pivot pin has, at least in some regions, an outer profile, and the stop surface of the at least one pivot element has a complementary profile engageable with the outer profile of the pivot pin. This increases engagement of the respective parts with each other and the holding force of the fixation.

Advantageously, the outer profile of the pivot pin is formed as an outer thread, and the stop surface of the at least one pivot element is formed as a thread section, advantageously, complementary to the outer thread of the pivot pin. With this embodiment, the at least one pivot elements assumes the function of a threaded nut. This function as a thread is particularly pronounced with a fixation device having a plurality of radially deflectable pivot elements arranged radially outwardly with respect to the pivot axis.

Advantageously, at least one of the outer profile of the pivot pin and the profile on the stop surface of the at least one pivot element is formed as a saw tooth profile. The free end of the pivot pin with an outer profile is easily insertable in the fixation device, e.g., upon mounting of the auxiliary handle on the power tool. As a result, each thread is engaged with the thread section on the at least one pivot element. Simultaneously, with the formation of the outer profile and/or the stop surface profile as a saw tooth thread, disengagement under a load is even more reliably prevented.

Advantageously, the fixation device has a guide member having at least one, oriented radially outwardly, guide recess that opens toward the pivot axis for guiding the at least one, radially deflectable pivot element. This provides for guidance of the at least one pivot element for displacement of the pivot pin from its fixed position to its release position. The number of the guiding recesses in the guide member corresponds at least to the number of the radially deflectable pivot elements provided in the fixation device.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS:

The drawings show.

In the drawings, the same parts are designated with the same reference numerals.

DETAILED DESCRIPTION OF THE PREFERRED EMBODIMENT

Figure 1:
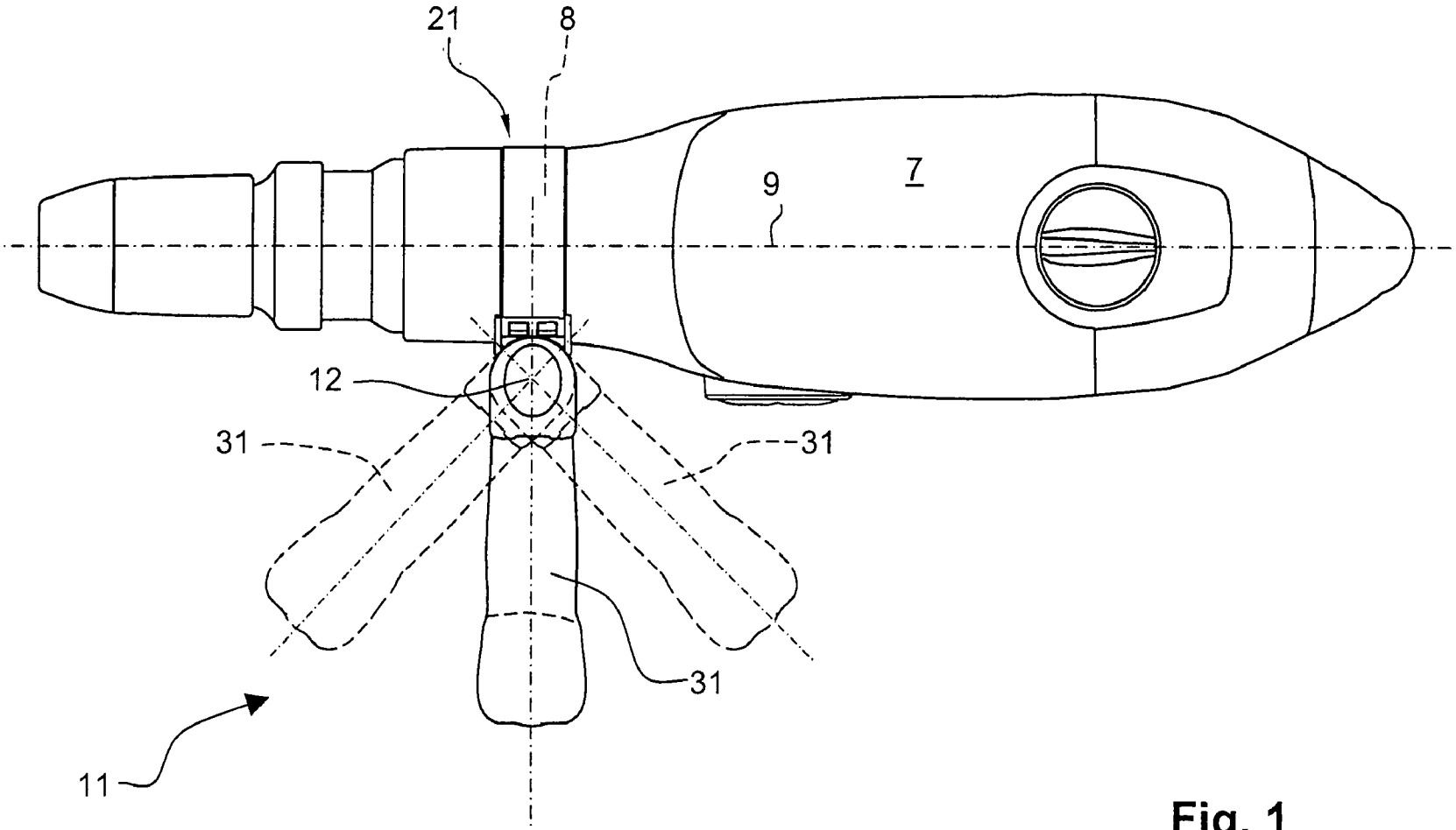
FIG. 1 a plan view of a hand-held power tool with an auxiliary handle according to the present invention.

A hand-held power tool 7, which is shown in FIG. 1, includes an auxiliary handle 11 according to the present invention that is formed as a side handle and is releasably secured on a cylindrical section 8 of the power tool 7. The auxiliary handle 11 has a gripping member 31 for grasping and holding the auxiliary handle 11 and pivotable about a pivot axis 12 toward an operational axis 9 of the power tool 7 to adjust the gripping position on the power tool 7, when needed.

Figure 2:
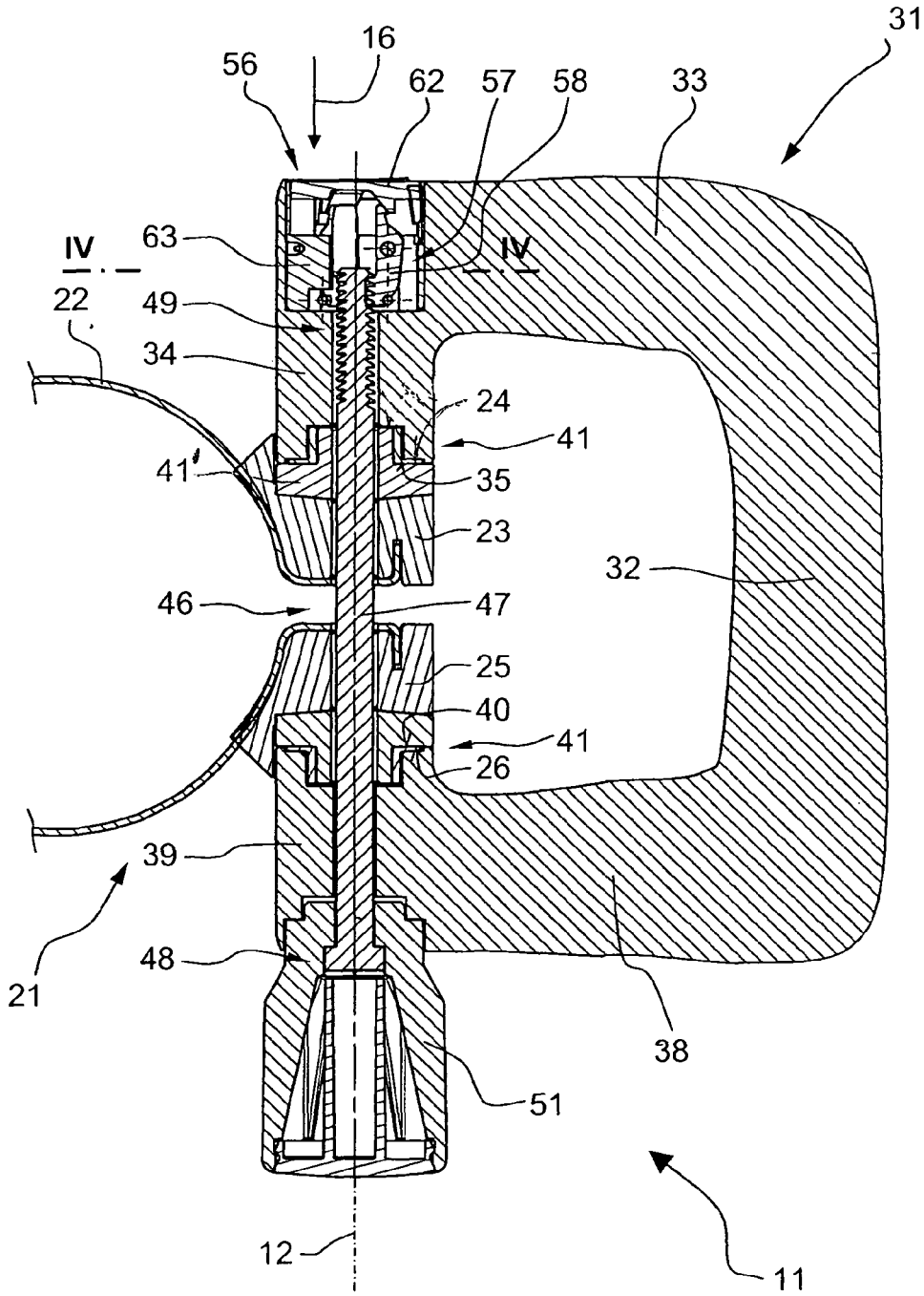
FIG. 2 a cross-sectional view of the auxiliary handle along its pivot axis with its quick-release device in a securing position.
Figure 3:
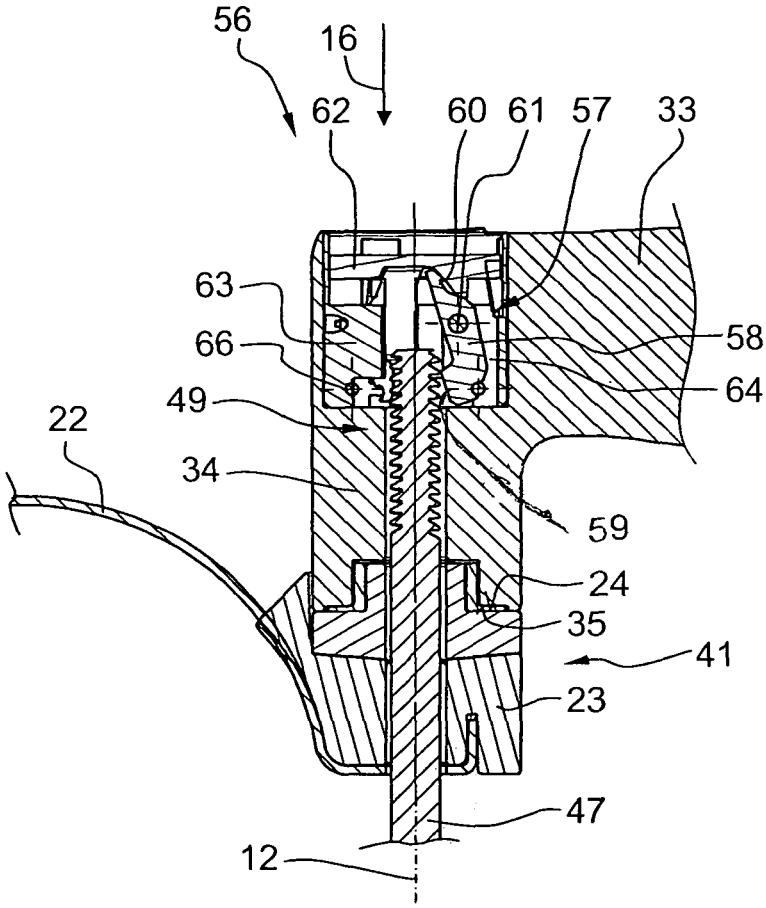
FIG. 3 a detailed cross-sectional view of the quick-release device shown in FIG. 2 at an increased, in comparison with FIG. 2, scale.
Figure 4:
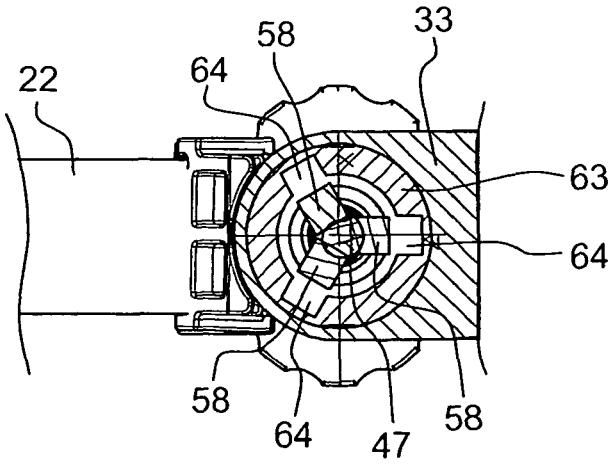
FIG. 4 a cross-sectional view of the quick-release device along line IV-IV in FIG. 2.

The auxiliary handle 11 has, as shown in FIGS. 2-3, a clamping section 21 for securing the auxiliary handle 11 on the power tool 7 and having a tightening band 22. The ends of the tightening band 22 are held in two clamps 23 and 25.

The gripping member 31 of the auxiliary handle 11 is essentially U- or D-shaped and has a base 32 and two legs 33 and 38 projecting from the base 32. On the leg 33, there is provided a first bearing section 34 adjacent to the second leg 38, and on the leg 38, there is provided a second bearing section 39 adjacent to the first leg 33.

Between the clamping section 21 and the gripping member 31, there is provided a lockable lag hinge 46 having a pivot pin 47 having a longitudinal axis that forms the pivot axis 12. The pivot pin 47 extends through the ends of the tightening band 22, the clamps 23, 25 and the bearing sections 34 and 39 which all form articulation sleeves of the lag hinge 46. A rotary knob that forms a tensioning member 51 for tightening and releasing the clamping section 21 is fixedly secured on an end 48 of the pivot pin 47 in the region of leg 38 of the gripping member 31.

Between the clamps 23 and 25 and end surfaces 24 and 26 at the free end of the first bearing section 34 and at the free end of the second bearing section 39, respectively, there is provided a locking device 41 for locking and releasing the lag hinge 46 and formed integrally with respective clamps 23, 25. The locking device 41 has a flange section 41' and sleeve-shaped section received in a recess formed in end surfaces 24 and 26. The locking device 41 is displaceable with the respective clamp 23, 25. For a formlocking engagement of the parts with each other, the adjacent contact surfaces 35 and 40 of respective flanges 41' and the end surfaces 24 and 26 of the bearing sections 34 and 39 are provided, respectively, with toothings and counter-toothings, which engage in each other in the fixed condition of the auxiliary handle 11.

On a section of the gripping member 31, there is further provided, in the region of the first bearing section 34, a quick-release device 56 which is arranged on an end 49 of the pivot pin 47 opposite the end 48 of the pivot pin 47 with the tensioning member 51.

The quick-release device has a fixation device 57 for axially securing the pivot pin 47, and an actuation member 62 for operating the fixation device 57 so that the fixation device 57 releases the pivot pin 47. The actuation member 62 is formed as a pressure knob displaceable along the pivot axis 12. Upon actuation of the actuation member 62, the fixation device 57 is displaced from its securing position in which it engages the pivot pin 47 for axially securing the pivot pin 47, to its release position for releasing the pivot pin 47. In the release position of the fixation device, the pivot pin 47 is axially displaced, which simultaneously loosens the clamping section 21 and releases the lag hinge 46.

The fixation device 57 has three pivot elements 58 which are uniformly circumferentially distributed radially outwardly with respect to the pivot axis, and are radially deflectable with respect to the pivot axis 12 of the lag hinge 46. The pivot elements 58 each has a stop section 59 engageable with pivot pin 47 and a control surface 60 engageable with the actuation member 62. Each of the pivot elements 58 has a pivot support 61 that supports a respective pivot element 58 for a pivotal movement thereabout. At an end of each pivot element 58 remote from the actuation member 62, there is provided a groove for a circumferentially arranged rubber ring that forms a spring element 66 for biasing the pivot element 58 in the direction of the pivot axis 12, forcing the pivot element 58 to its fixation position for axially securing the pivot pin 47.

The fixation device 57 has further a guide member 63 with three, extending radially outwardly guide recesses 64 which open in a direction of the pivot axis 12 and are designed for guiding the radially deflectable pivot elements 58.

The pivot pin 47 is provided at its end 49 adjacent to the fixation device 57 in some regions with an outer profile in form of a saw tooth thread. The pivot elements 58 are provided, on their stop surfaces with a profile engageable with the outer profile of the pivot pin 47. The stop surface profile is likewise formed as a section of a saw tooth profile.

For mounting the auxiliary handle 11 and its gripping member 31 on the power tool 7, firstly, the tightening band 22 is placed about the corresponding section 8 of the power tool 7, and the pivot pin 47 is pushed in the direction of the leg 33 of the gripping member 31 and into the quick-release device 56. At that, the pivot elements 58 are deflected radially outwardly. Due to the spring-biasing force acting on the pivot elements 58, they rest with their profiles continuously in the outer profile on the pivot pin 47. With few, mostly with only one turn of the tensioning member 51, the auxiliary handle 11 is secured on the power tool 7.

Upon tightening of the clamping section 2, corresponding contact surfaces of 24 and 26 of the bearing sections 34 and 39 and the corresponding contact surfaces 35, 40 contact each other or become engaged. The auxiliary handle 11 is reliably held even during a chiseling operation of the power tool.

For loosening the clamping section 21 or for releasing the lag hinge 46, in order to enable a pivotal movement of the gripping member 31 (see FIG. 1, dashed positions of the gripping member 31), the actuation member 62 is axially displaced along the pivot axis 12 in the direction of arrow 16 or in the direction of the clamping section 21 by being depressed. The actuation member 62 acts on the control sections 60 of the pivot elements 58, the stop surfaces 59 of which pivot radially outwardly due to the displacement of the actuation member 62. In this position of the quick-release device 56, the lag hinge 46 is released, and the tightening of the clamping section 21 becomes loose. In this position of the quick-release device 56, the auxiliary handle 11 can change its orientation relative to the power tool or be removed therefrom.

When the actuation member 62 is released, the spring-biased pivot elements 58 pivot again in their securing position for axially securing the pivot pin 47 that again becomes axially fixed in the fixation device 57 of the quick-release device 56.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An auxiliary handle for a hand-held power tool (7), comprising:

a clamping section (21) for securing the auxiliary handle (11) on a section of the power tool (7);

a gripping member (31) for holding the auxiliary handle (11);

a lockable lag hinge (46) provided between the clamping section (21) and the gripping member (31) and having a pivot pin (47);

clamping means (23, 25) supported on the hinge pin (47) for securing the clamping section 921) on the section of the power tool;

a tensioning member (51) arranged on an end of the pivot pin (47), for tightening and loosening the clamping section (21);

a locking device (41) associated with the clamp means (23, 25), arranged between the clamping means (23, 25) and the gripping member (31), and displaceable between a locking position in which the lag hinge (46) is locked and the clamping section is tightened on the section of the power tool, and a release position in which the lag hinge (46) is released and the clamping section (21) becomes loose; and a quick-release device (56), operated independently from the tensioning member (51), for displacing the locking device from the locking position thereof into the release position thereof.

2. An auxiliary handle according to claim 1, wherein the quick-release device (56) has a fixation device (57) for axially securing the pivot pin (47), and an actuation member (62) for displacing the fixation device (57) from a first position in which the pivot pin is secured into a second position in which the fixation device (57) releases the pivot pin (47).

3. An auxiliary handle according to claim 2, wherein the actuation member (62) is provided on an end (49) of the pivot pin (47) opposite the end (48) on which the tensioning member (51) is arranged.

4. An auxiliary handle according to claim 2, wherein the actuation member (62) is formed as a pressure knob axially displaceable along the pivot axis (12) of the lag hinge (46).

5. An auxiliary handle according to claim 2, wherein the fixation device (57) comprises at least one pivot element (58) radially deflectable and arranged radially outwardly relative to the pivot axis (12) of the lag hinge (46) and having a stop section (59) engageable with the pivot pin (47), and a control section (60) engageable with the actuation member (62).

6. An auxiliary handle according to claim 5, wherein the fixation device (57) further comprises a plurality of additional radially deflectable pivot elements (58) arranged radially outwardly with respect to the pivot axis (12).

7. An auxiliary handle according to claim 5, further comprising spring means (66) for biasing the stop section (59) of the at least one pivot element (58) in a direction of the pivot axis (12).

8. An auxiliary handle according to claim 5, wherein the pivot pin (47) has, at least in some regions, an outer profile, and the stop section (59) of the at least one pivot element (58) has a profile engageable with the outer profile of the pivot pin (47).

9. An auxiliary handle according to claim 8, wherein at least one of the outer profile of the pivot pin (47) and the profile on the stop section (59) of the at least one pivot element (58) is formed as a saw tooth thread profile.

10. An auxiliary handle according to claim 5, wherein the fixation device (57) has a guide member (63) having at least one, oriented radially outwardly, guide recess (64) that opens toward the pivot axis (12) for guiding the at least one, radially deflectable pivot element (58).

11. An auxiliary handle according to claim 1, wherein the gripping member (31) has two, spaced from each other bearing sections (34, 39), and the pivot pin (47) extends through the bearing sections (34, 39), wherein the clamping means has two clamps (23, 25), and the locking device (41) has two locking elements located between respective clamps (23, 25) and respective bearing sections (34, 39) and engageable with the bearing sections (34, 39) for locking the lag hinge (46) and tightening the clamping section on the section of the power tool.

12. An auxiliary handle according to claim 11, wherein each locking element has a flange section (41') and a sleeve-shaped section received in a recess formed in an end surface (24, 26) provided at a free end of a respective bearing section (34, 39).

13. An auxiliary handle according to claim 12, wherein the end surface (24, 26) of the respective bearing section (34, 39) has a shaped profile, and an end surface (35, 40) of the respective flange section (41') has a complementary shaped profile engageable with the shaped profile of the end surface (24, 26) of the respective bearing sections (34, 39) in the locking position of the locking device (41).

* * * * *